US005881907A

United States Patent [19]

Schutz

[11] Patent Number: 5,881,907

[45] Date of Patent: Mar. 16, 1999

[54] SEALING CAP WITH METAL INSERT FOR SHEET METAL CONTAINERS FOR CORROSIVE LIQUIDS

[75] Inventor: Udo Schutz, Selters, Germany

[73] Assignee: Schutz-Werke GmbH & Co. KG, Selters, Germany

[21] Appl. No.: 348,890

[22] Filed: Nov. 25, 1994

[30] Foreign Application Priority Data

Nov. 24, 1993 [DE] Germany ..... 43 40 084.1

[51] Int. Cl.[6] ..... B65D 1/42

[52] U.S. Cl. ..... 220/644; 215/42; 215/274; 215/276; 215/330; 215/331; 215/354; 215/341; 220/304; 220/327; 220/288; 220/378; 220/648; 220/658

[58] Field of Search ..... 220/304, 319, 220/327, 328, 288, 641, 643, 644, 646, 648, 378, 658, 601; 215/42, 556, 364, 363, 341, 331, 354, 330, 276, 273

[56] References Cited

U.S. PATENT DOCUMENTS

| | | | |
|---|---|---|---|
| 2,116,421 | 5/1938 | Williams | 215/276 |
| 3,229,886 | 1/1966 | Grogel | 220/658 X |
| 3,343,579 | 9/1967 | Clark | 215/42 X |
| 3,721,361 | 3/1973 | Barry et al. | 215/330 |
| 4,142,756 | 3/1979 | Henning et al. | 220/304 X |
| 4,164,302 | 8/1979 | Gerdes | 220/304 |
| 4,299,330 | 11/1981 | Walter | 220/288 |
| 4,316,318 | 2/1982 | Mineo | 220/228 X |
| 4,534,477 | 8/1985 | Laub, III | 215/330 X |
| 4,664,273 | 5/1987 | Simon | 215/330 X |
| 4,667,499 | 5/1987 | Bull | 220/658 X |
| 4,815,783 | 3/1989 | Montreuil et al. | 220/304 X |
| 4,896,782 | 1/1990 | Hawkins et al. | 215/276 X |
| 4,913,299 | 4/1990 | Petro | 215/330 |
| 5,002,198 | 3/1991 | Smith | 220/276 |
| 5,016,775 | 5/1991 | Budenbender | 220/288 X |
| 5,052,576 | 10/1991 | Budenbender | 220/288 X |
| 5,174,460 | 12/1992 | Minnette | 215/330 X |
| 5,330,068 | 7/1994 | Duhaime et al. | 220/378 X |
| 5,356,030 | 10/1994 | Smith | 220/276 |

FOREIGN PATENT DOCUMENTS

| | | |
|---|---|---|
| 3926820 | 2/1990 | Germany . |
| 92 05 987.2 | 9/1992 | Germany . |

*Primary Examiner*—Allan N. Shoap
*Assistant Examiner*—Robin A Hylton
*Attorney, Agent, or Firm*—Young & Thompson

[57] ABSTRACT

The top (2) of a sheet metal container (1) for the transportation and storage of liquids has a central fill opening (3) which is edged by a neck (5) which is perpendicular to the top surface (4) of the container. A plastic or metal ring (6) with an external thread (7) is pressed down against the top surface (4) by the upper edge (8) of the neck (5). The neck is swaged outwardly. The threaded ring (6) is protected against rotation by form-fit connections on the neck (5). A plastic screw cap (11) into which a disc-shaped insert (12) of special steel is pressed, is screwed onto the threaded ring (6). Between the outside edge (13) of the cap insert (12) and a ring projection (14) of the latter, an annular groove (15) for holding a gasket (16) is molded into the insert, and by this gasket (16) the screw cap (11) is sealed against the upper edge (8) of the neck (5).

3 Claims, 3 Drawing Sheets

SEALING CAP WITH METAL INSERT FOR SHEET METAL CONTAINERS FOR CORROSIVE LIQUIDS

FIELD OF THE INVENTION

The invention relates to threaded necks on openings in the top and/or bottom of sheet metal containers for liquids for screwing on a screw cap or a connection piece for holding a dispensing gun or attaching a fill hose, the connection of a discharge pump or a drain fitting, or installation of a level indicator, overfill safety device, vent valve or the like.

BACKGROUND OF THE INVENTION

In sheet metal containers of varied designs for liquids which are available on the market the necessary openings are punched out of the top or bottom and onto the edge of the opening a threaded neck is welded which consists for example of a sheet metal pipe section with pressed-in thread and an attachment flange or a metal pipe section with a cut thread and an attachment flange which is welded on the pipe section or which is cast in one piece with it.

Production of these known sheet metal containers is comparatively expensive due to the required leak-proof welding of the threaded neck onto the edges of the opening.

The problem of the invention is to make production of sheet metal containers cheaper by structural improvement of the threaded neck on the container openings.

SUMMARY OF THE INVENTION

This problem is solved according to the invention by a threaded neck for sheet metal containers with the features of patent claim 1.

The subclaims are aimed at feasible developments of the invention.

Use of a threaded ring of plastic or metal according to the invention, which is seated on a neck formed from the top or bottom of a sheet metal container around an opening and which is held on the neck by the neck edge swaged to the outside enables simplified and cheaper production of sheet metal containers for liquids.

BRIEF DESCRIPTION OF THE DRAWINGS

The invention is explained below using drawings.

DETAILED DESCRIPTION OF THE INVENTION

Figure 1:
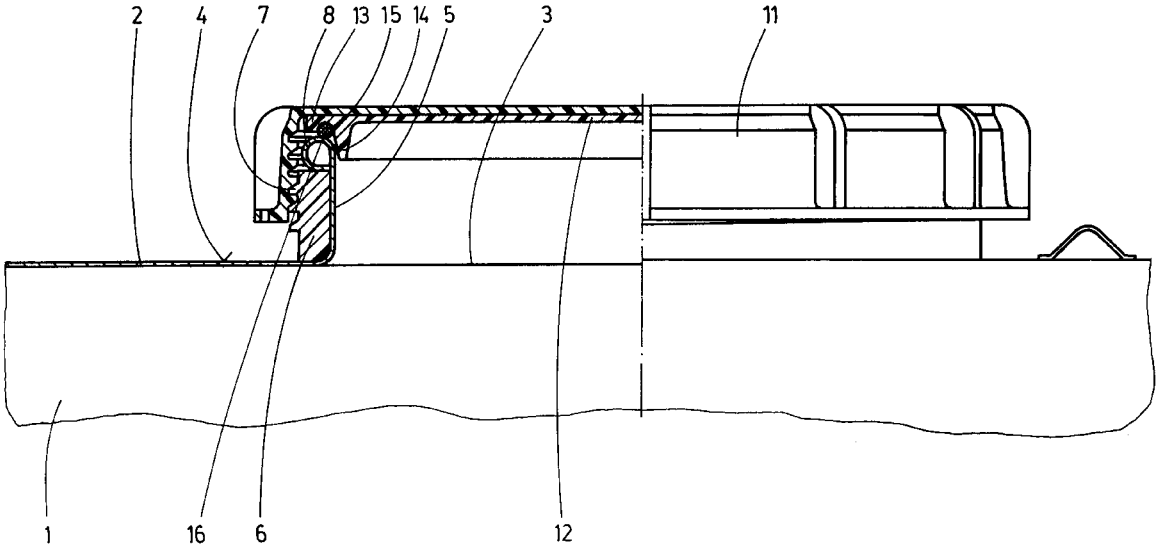
FIG. 1 shows a sectional representation of a top of a sheet metal container in the area of the fill opening.
Figure 2:
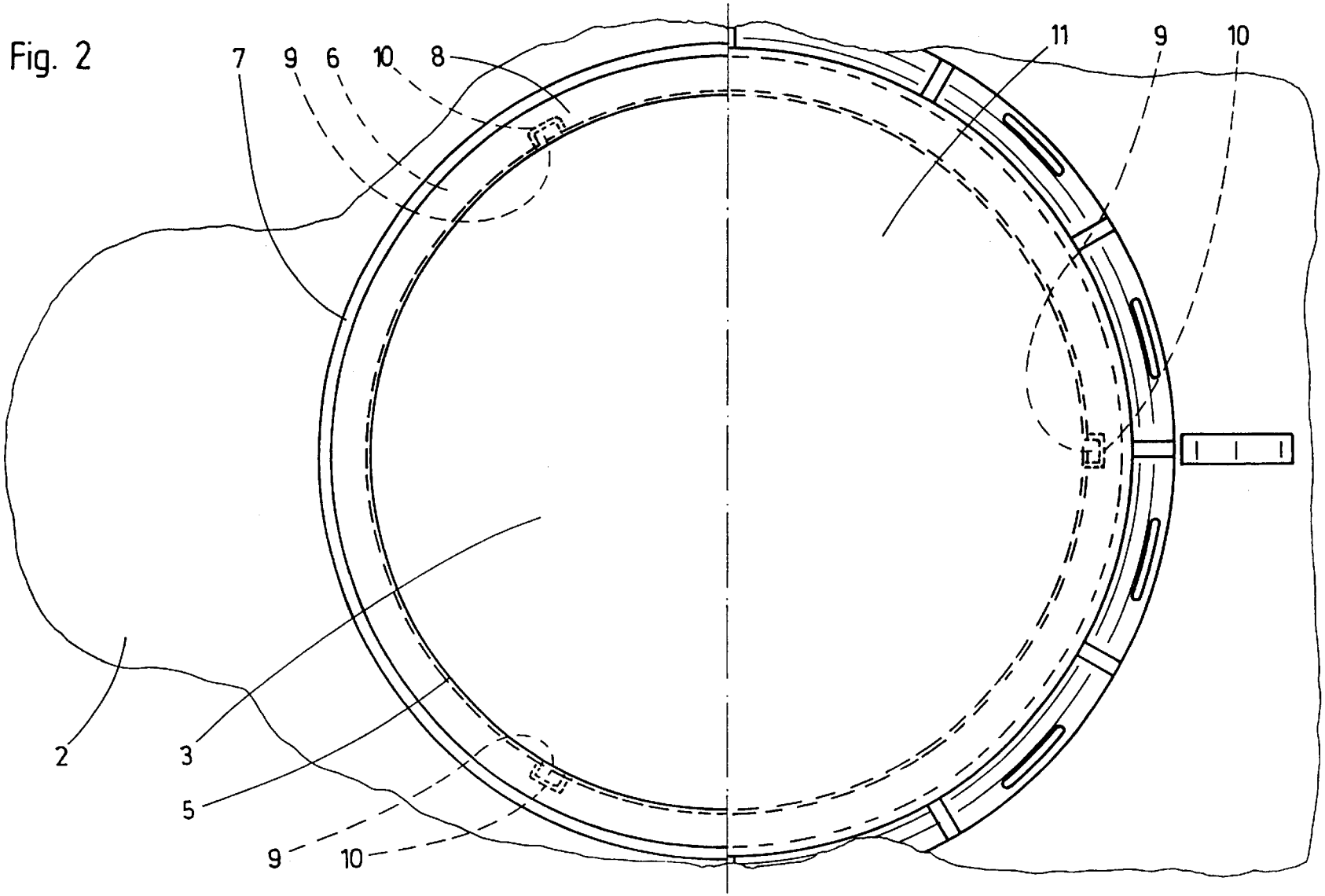
FIG. 2 shows an overhead view of the top area according to FIG. 1
Figure 3:
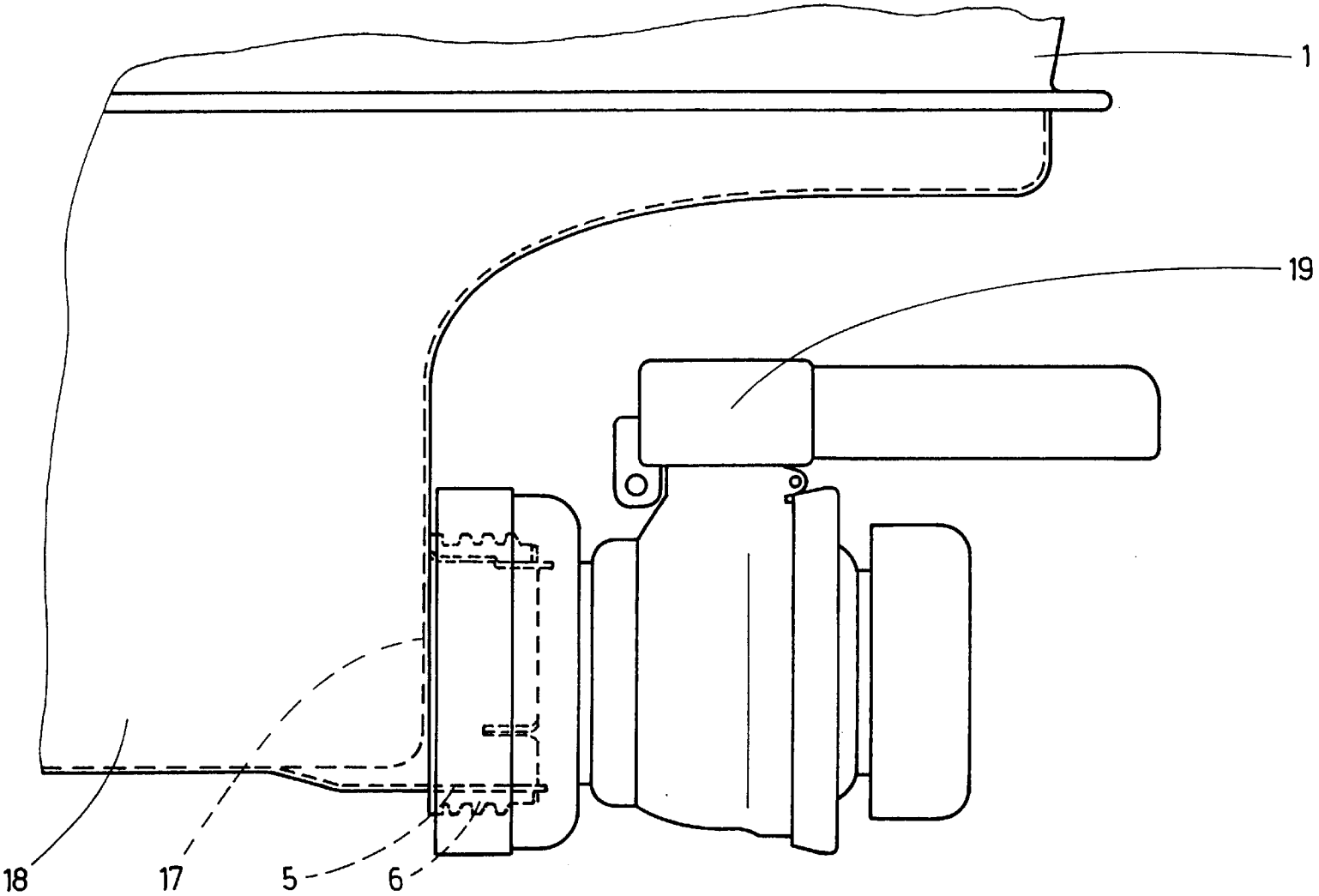
FIG. 3 shows a sectional representation of a container bottom with the drain neck.

The top 2 of a sheet metal container 1 for the transport and storage of liquids has a central fill opening 3 which is edged by a neck 5. The neck 5 is perpendicular to a top surface 4 and is formed from the top.

A plastic or metal ring 6 with an outside thread 7 is pressed down against the top surface 4 by an upper edge 8 of the neck 5. The end edge of the neck, which is swaged to the outside, is first rolled over outwardly and then inwardly to form a hollow bead. The end edge is seated on the neck 5.

The Threaded ring 6 is protected against twisting by three projections 9 which are pointed to the outside, which are formed on the neck 5 with the same spacing, and which fit into corresponding recesses 10 of the threaded ring 6.

A disc s hap ed insert 12 of steel is pressed into plastic screw cap 11. The plastic screw cap 11 is screwed onto the threaded ring 6 which sits on the neck 5 of the fill opening 3 in the top 2. Between the outside edge 13 of the cap insert 12 and ring projection 14 of the latter, there is molded an annular groove 15 for holding a resiliently deformable gasket 16. The gasket seals screw cap 11 against the upper edge 8 of the neck 5, the edge being swaged to the outside.

The threaded ring 6 is seated on the neck 5 which edges a drain opening 17 in the bottom 18 of the sheet metal container 1, in the same way as in the neck 5 of the fill opening 3 of the container top 2. A ball valve 9 is screwed on the threaded ring 6 to remove liquid from the container 1.

In the transport and storage of corrosive liquids in containers of high quality sheet metal the neck on each opening and the cap insert of steel prevent contact of the corrosive liquid with the screw cap of plastic or with the drain fitting so that container leaks due to the action of the corrosive liquid in the container are prevented. The plastic screw cap combined with the steel insert is much more economical than a screw cap produced completely of steel, which is used to date in sheet metal containers for transport and storage of corrosive, environmentally-threatening liquids.

I claim:

1. A sheet metal container for the transport and storage of corrosive liquids comprising:

a neck, a top, a bottom, said neck extending outwardly from the top and defining at least one fill and drain opening in the top, a ring made of one of plastic and metal surrounding the neck and having an external screw thread, said neck having an upper edge rolled to the outside which presses the ring against the top of the sheet metal container, a plastic sealing cap in screw-threaded engagement with the screw thread of the ring, said sealing cap having a disk-shaped metal insert disposed between the upper edge of the neck and the sealing cap for protecting said sealing cap against corrosive liquid in said container, said insert having an annular projection extending into the neck and an annular groove disposed between an outer edge of said insert and said annular projection, and a resiliently deformable gasket disposed in said annular groove for providing a seal between the insert and the neck.

2. A sheet metal container according to claim 1, wherein the insert is of steel, and is pressed into the plastic sealing cap.

3. A sheet metal container according to claim 1, wherein the neck has outwardly extending projections thereon that fit into corresponding recesses in the ring to prevent rotation of the ring relative to the neck.

* * * * *